US007347531B2

(12) United States Patent
Kachi

(10) Patent No.: US 7,347,531 B2
(45) Date of Patent: Mar. 25, 2008

(54) INKJET RECORDING HEAD AND IMAGE FORMATION APPARATUS

(75) Inventor: Yasuhiko Kachi, Kaiseimachi (JP)

(73) Assignee: FujiFilm Corporation, Tokyo (JP)

( * ) Notice: Subject to any disclaimer, the term of this patent is extended or adjusted under 35 U.S.C. 154(b) by 257 days.

(21) Appl. No.: 10/936,479

(22) Filed: Sep. 9, 2004

(65) Prior Publication Data

US 2005/0057608 A1 Mar. 17, 2005

(30) Foreign Application Priority Data

Sep. 12, 2003 (JP) ..... 2003-321665

(51) Int. Cl.
*B41J 2/135* (2006.01)

(52) U.S. Cl. ..... 347/45

(58) Field of Classification Search ..... 347/45, 347/47, 28, 33, 95, 21
See application file for complete search history.

(56) References Cited

U.S. PATENT DOCUMENTS 5,949,454 A * 9/1999 Nozawa et al. ..... 347/45
6,102,518 A * 8/2000 Taylor ..... 347/29

FOREIGN PATENT DOCUMENTS

| | | |
|---|---|---|
| JP | 9-1814 A | 1/1997 |
| JP | 2000-127388 A | 5/2000 |
| JP | 2001-71520 A | 3/2001 |
| JP | 2001-130014 A | 5/2001 |
| JP | 2001-158106 A | 6/2001 |

* cited by examiner

*Primary Examiner*—Shih-Wen Hsieh
(74) *Attorney, Agent, or Firm*—Birch, Stewart, Kolasch & Birch, LLP

(57) ABSTRACT

The inkjet recording head comprises: a nozzle which discharges ink; a liquid-repellent treatment part which repels the ink; and a sealing liquid affinity treatment part that has an affinity with sealing liquid used for sealing off the ink inside the nozzle from outside air, wherein the liquid-repellent treatment part and the sealing liquid affinity treatment part are provided on a discharge surface in which the discharge port of the nozzle is formed.

13 Claims, 9 Drawing Sheets

INKJET RECORDING HEAD AND IMAGE FORMATION APPARATUS

This Non-provisional application claims priority under 35 U.S.C. § 119(a) on Patent Application No(s). 2003-321665 filed in Japan on Sep. 12, 2003, the entire contents of which are hereby incorporated by reference.

BACKGROUND OF THE INVENTION

1. Field of the Invention

The present invention relates to an inkjet recording head and image formation apparatus, and more particularly to a structure of a recording head suitable for preventing a discharge defects due to ink drying inside nozzles and an image formation apparatus using the recording head.

2. Description of the Related Art

Inkjet-type image formation apparatuses (inkjet recording apparatuses) attach ink droplets on a recording medium such as recording paper by discharging ink from nozzles provided to a recording head in accordance with a print signal while moving the recording medium relative to the recording head, and an image is formed on the printing medium by ink dots.

In these inkjet recording apparatuses, when the nozzles for discharging ink droplets are exposed to the atmosphere and meniscus (i.e. the boundary between the ink and the outside air) is left exposed for a long period of time, the viscosity of the ink inside the nozzles increases due to drying, and this causes discharge defects. It is for this reason that the print head ink is normally covered with a cap after printing to prevent the meniscus from drying out.

Disclosed as a separate technique in Japanese Patent Application Publication No. 9-1814 is an inkjet recording apparatus having a viscous material supply unit for delivering a viscous material that prevents the ink discharge surface from drying, and also having a viscous material removal unit for removing the delivered viscous material from the print head surface. In accordance with this publication, there is disclosed a structure whereby a viscous material is delivered to a discharge port by fitting a cap loaded with viscous material over the nozzle surface (ink discharge port surface) of the print head, and there is also disclosed a structure whereby the viscous material on the discharge surface is wiped away by relatively sliding a blade composed of rubber or another elastic material on the discharge port surface. The viscous material is preferably one having moisture retention or moistening properties, and glycerin and ethylene glycol are exemplified as viscous materials that are suitable in the case of water-based ink.

Disclosed in Japanese Patent Application Publication No. 2001-71520 is an inkjet printer provided with a sliding contact member that cleans as it slidably rubs against the discharge surface, applies a coating film material on the discharge surface, and forms a barrier film on the nozzles. Silicone oil is exemplified as the coating film material, and the sliding contact member has a structure in which a wiping layer for cleaning and a coating layer for applying the coating film material are laminated.

However, the structures proposed in the prior art use a large quantity of sealing liquid in order to apply the viscous material or the coating film material (hereinafter these are generically referred to as "sealing liquid") over the entire surface of the ink discharge surface of the print head. The ink discharge surface of the print head is treated with a liquid repellent (water repellent) that repels ink, so it is also not a simple matter to apply the sealing liquid.

SUMMARY OF THE INVENTION

The present invention was contrived in view of such circumstances, and an object thereof is to provide an inkjet recording head and an image formation apparatus that can reduce the amount of sealing liquid used in comparison with prior art, and can improve the coating and removal performance of the sealing liquid.

To achieve the above-stated object, the present invention is directed to an inkjet recording head comprising a nozzle for discharging ink, a liquid-repellent treatment part for repelling the ink, and a sealing liquid affinity treatment part that has an affinity with sealing liquid used for sealing off the ink inside the nozzle from outside air, wherein the liquid-repellent treatment part and the sealing liquid affinity treatment part are provided on a discharge surface in which the discharge port of the nozzle is formed.

The liquid-repellent treatment part is an area that has the effect of repelling ink and also has the effect of repelling sealing liquid. On the other hand, the sealing liquid affinity treatment part has affinity for the sealing liquid, is an area in which sealing liquid is easily attached, and has the effect of repelling ink. Therefore, in accordance with the present invention, the sealing liquid provided to the discharge surface is attached to the sealing liquid affinity treatment part, whereas the liquid-repellent treatment part inhibits the attachment of sealing liquid.

The meniscus can be reliably sealed with a small amount of sealing liquid in comparison with prior art by locally forming a sealing liquid affinity treatment part in areas that require sealing liquid to be attached such as an area around the nozzle.

In the present invention, the liquid-repellent treatment part and the sealing liquid affinity treatment part are preferably separated by a range of several hundred micrometers in diameter with the discharge port of the nozzle as the center.

At least two types of surface treatment parts may be provided as sealing liquid affinity treatment parts and liquid-repellent parts to the discharge surface of the recording head, and a separate surface treatment part can be further added.

The inkjet recording head according to an aspect of the present invention is configured such that the liquid-repellent treatment part is formed in an area of the discharge surface that is in contact with the discharge port of the nozzle, and the sealing liquid affinity treatment part is formed on the outside of the liquid-repellent treatment part.

In accordance with this aspect, the meniscus can reliably be prevented from drying out with a small amount of sealing liquid without sacrificing ink discharge performance by making the area in the vicinity of contact with the discharge port of the nozzle into a liquid-repellent treatment part, and making the area around the exterior thereof into a sealing liquid affinity treatment part.

In this case, a preferred aspect is one in which the liquid-repellent treatment part for repelling the ink is formed in an area of the discharge surface further outside the sealing liquid affinity treatment, and the sealing liquid affinity treatment part is configured with the minimal required area.

As another aspect of the present invention, the sealing liquid affinity treatment part has a recess shape. In this case, the side surface (wall surface) of the recess portion may be provided with affinity for the sealing liquid.

The holding characteristics of the sealing liquid are improved by the holding force produced by the recess edges of the sealing liquid affinity treatment part. The sharper the edge is, the greater the holding force is. There is an effect of stabilizing the contact angle between the nozzle surface and the wetting sealing liquid by providing an edge through the use of an irregular shape in the contact liquid holding area of the sealing liquid affinity treatment part, and the sealing liquid can be stably attached as a result.

Another aspect of the present invention provides an image formation apparatus that uses the inkjet recording head related to the present invention. In other words, the image formation apparatus of the present invention has a sealing liquid application part for providing the sealing liquid to the discharge surface, and a sealing liquid removal part for removing the sealing liquid attached to the discharge surface.

The image formation apparatus that uses the inkjet recording head forms an image on a printing medium by discharging ink from the nozzles of the recording head as the printing medium moves relative to the recording head. With the image recording apparatus of the present invention, sealing liquid is provided to the discharge surface of the head by the sealing liquid application part when printing is completed or at other times as needed, and the sealing liquid is attached to the sealing liquid affinity treatment part. The ink inside the nozzles is shielded from the outside air by the attached sealing liquid, and the ink is prevented from drying out. The increase in viscosity of the ink can thereby be inhibited, and the occurrence of discharge defects can be prevented.

When printing, on the other hand, the sealing liquid attached to the discharge surface is removed with the aid of the sealing liquid removal part prior to printing. The discharge ports of the nozzles are opened and ink can be discharged.

As a specific aspect of the sealing liquid application part, there are aspects in which a liquid supply roller that is rotatably driven while in contact with the discharge surface is used, and in which a blade for slidably rubbing against the discharge surface is used.

The material of the liquid supply roller preferably has affinity for the sealing liquid and is an expanded material with osmotic characteristics. The material affinity for the sealing liquid of the liquid supply roller is furthermore preferably set to be less than the sealing liquid affinity treatment carried out on the discharge surface. This aspect improves the sealing liquid coating performance.

In an aspect in which a blade is used as the sealing liquid application part, adequate coating can be formed by enhancing the contact with the discharge surface and maintaining a clearance with the recess through the use of soft rubber etc.

Specific aspects of the sealing liquid removal method include those in which a liquid absorbent roller that is rotatably driven while in contact with the discharge surface is used, and those in which a blade for slidably rubbing against the discharge surface is used.

The material of the liquid absorbent roller preferably has affinity for the sealing liquid and is an expanded material with osmotic characteristics, and the affinity is furthermore preferably set to be greater than that afforded by the sealing liquid affinity treatment carried out on the discharge surface. This aspect improves the sealing liquid removal performance.

In an aspect in which a blade is used as the sealing liquid removal part, removal performance is improved by, for example, using soft rubber and increasing the adherence with the sealing liquid affinity treatment part.

In this aspect of the present invention, the examples of the recording head include a shuttle-scan print head for performing printing as the print head moves reciprocally in a direction that is substantially perpendicular to the feed direction of the printing medium, and a full-line print head with one or more rows of nozzles in which a plurality of nozzles for discharging ink are arrayed across a length corresponding to the entire width of the printing medium in a direction substantially perpendicular to the feed direction of the printing medium, but are not limited to the above.

A "full-line recording head" is normally disposed along the direction perpendicular to the relative feed direction of the printing medium, or along the diagonal direction given a predetermined angle with respect to the direction perpendicular to the feed direction. The array form of the nozzles in the recording head may be a single row array in the form of a line, or a matrix array composed of a plurality of rows. Furthermore, with the combination of short recording head units having a row of nozzles that do not have lengths that correspond to the entire width of the printing medium, the nozzle rows (i.e. rows of image recording device) may be configured corresponding to the entire width of the printing medium.

The term "printing medium" refers to a medium that is printed on by a recording head, and is called an image formation medium, a printing medium, an image receiving medium, etc. Specific aspects of the printing medium include continuous paper, cut paper, seal paper, OHP sheets, and other resin sheets, as well as film, cloth, printed boards with inkjet-formed wiring patterns, and various other media without regard to materials or shapes.

The conveyance device for moving the recording medium relative to the recording head includes aspects of conveying the printing medium with respect to a stationary (or fixed) recording head, moving the recording head with respect to a stationary printing medium, and moving both the recording head and the printing medium.

Herein the term "printing" expresses the concept of not only the formation of characters, but also the formation of images with a broad meaning that includes characters.

According to the present invention, two types of surface treatment parts, the liquid-repellent treatment part and the sealing liquid affinity treatment part, are provided to the ink discharge surface of the recording head. Therefore, sealing liquid can be locally attached to the sealing liquid affinity treatment part and the consumption of sealing liquid can be reduced in comparison with prior art.

Meanwhile, by forming a liquid-repellent treatment part in the vicinity area in contact with the discharge port of the nozzle and forming a sealing liquid affinity treatment part outside thereof, a film of sealing liquid can be formed only in the area around the nozzles as well as the discharge performance of the ink can be assured.

Furthermore, by providing an uneven edge in the contact liquid holding area of the sealing liquid affinity treatment part, the application of sealing liquid can be facilitated and the sealing liquid can be stably attached.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of an Inkjet Recording Apparatus

Figure 1:
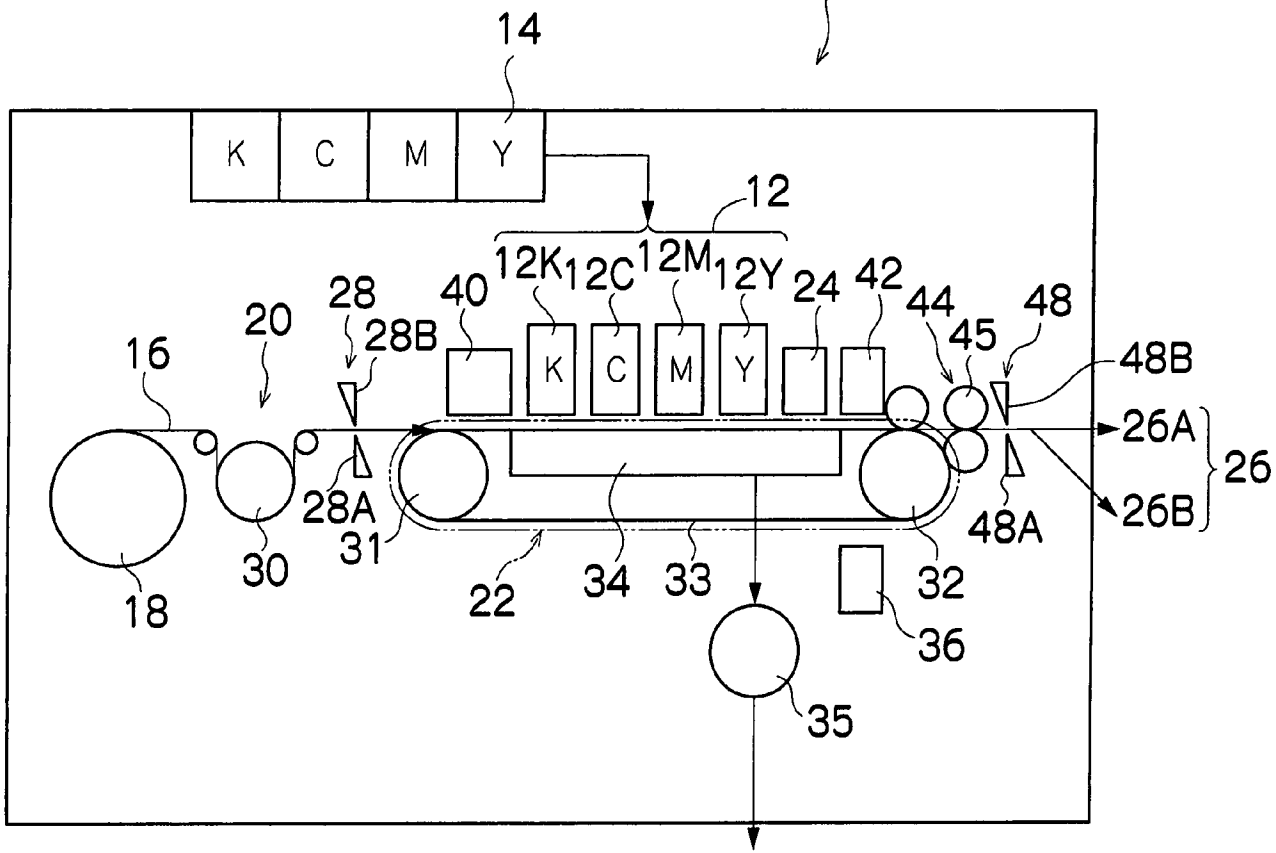
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that a information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction. The belt 33 is driven in the clockwise direction in FIG. 1 by the motive force of a motor (not shown in FIG. 1, but shown as a motor 88 in FIG. 6) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
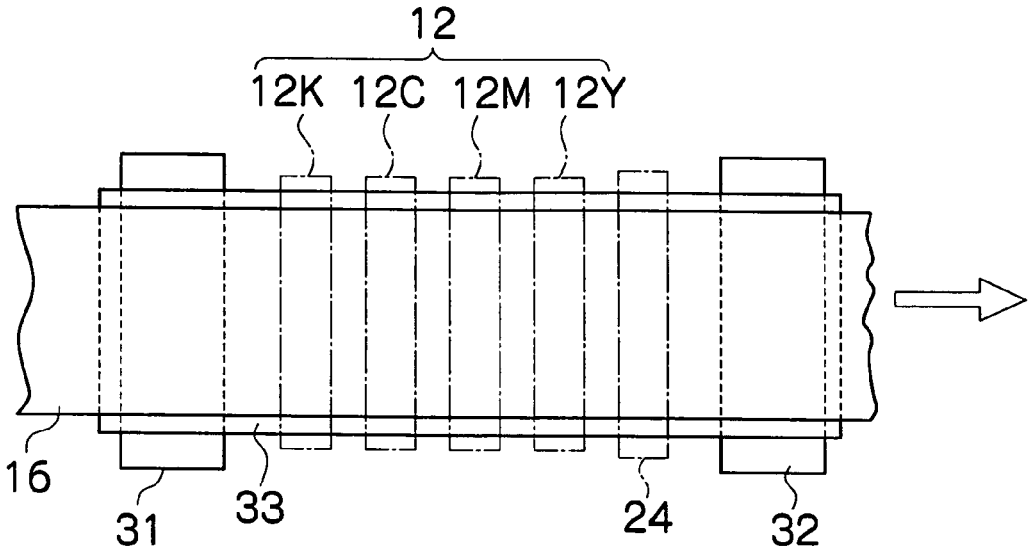
FIG. 2 is a plan view of principal components of an area around a printing unit of the inkjet recording apparatus in FIG. 1.

As shown in FIG. 2, the printing unit 12 forms a so-called full-line head in which a line head having a length that corresponds to the maximum paper width is disposed in the main scanning direction perpendicular to the delivering direction of the recording paper 16 (hereinafter referred to as the paper conveyance direction) represented by the arrow in FIG. 2, which is substantially perpendicular to a width direction of the recording paper 16. Although the structure is not described in detail, each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in this order from the upstream side along the paper conveyance direction. A color print can be formed on the recording paper 16 by ejecting the inks from the print heads 12K, 12C, 12M, and 12Y, respectively, onto the recording paper 16 while conveying the recording paper 16.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added. Moreover, a configuration is possible in which a single print head adapted to record an image in the colors of CMY or KCMY is used instead of the plurality of print heads for the respective colors.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

As shown in FIG. 1, the ink storing/loading unit 14 has tanks for storing the inks to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements, which are arranged two-dimensionally.

The print determination unit 24 reads a test pattern printed with the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, a sorter for collecting prints according to print orders is provided to the paper output unit 26A for the target prints.

Structure of the Nozzle

Figure 3:
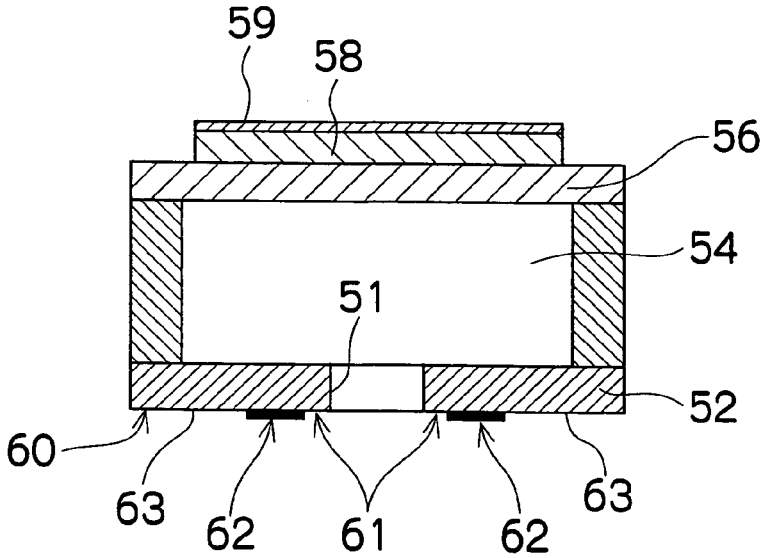
FIG. 3 is a cross section showing the schematic structure of the ink chamber for each nozzle formed in the print head.

FIG. 3 is a cross-sectional view showing the schematic structure of the ink chamber for each nozzle formed in the print head. In FIG. 3, the reference numeral 51 is an opening (nozzle) for discharging ink, 52 is a nozzle plate, 54 is a pressure chamber, 56 is a pressure plate, and 58 is an actuator.

The pressure chamber 54 provided to each nozzle 51 is connected to the common flow channel (not shown) inside the head by way of a supply port (not shown). The ink delivered from the ink storing/loading unit 14 passes through the common flow channel and is provided to the pressure chamber 54. An actuator 58 provided with a discrete electrode 59 is joined to the pressure plate 56, which constitutes the top surface of the pressure chamber 54; the actuator 58 is deformed by applying drive voltage to the discrete electrode 59; and pressure is applied to the ink inside the pressure chamber 54 to discharge the ink from the nozzle 51.

A method that ejects ink droplets by deforming the actuator 58 represented by a piezoelement (piezoelectric element) is adopted in the present embodiment, but the implementation of the present invention is not particularly limited to a method in which ink is discharged, and instead of the piezo-jet method, various methods may be adopted including a thermal jet method in which ink is heated by a heater or another heat source to generate bubbles, and ink droplets are ejected by the resulting pressure.

A liquid-repellent treatment is performed in the circumferential area 61 of the nozzle 51 on the ink discharge surface 60 of the nozzle plate 52 in which the nozzle 51 is formed, and a sealing liquid affinity treatment is performed in the area 62 outside of the area (hereinafter referred to as "first liquid-repellent treatment part") 61 that has been rendered liquid-repellent. The area 63 further outside the area (hereinafter referred to as "sealing liquid affinity treatment part") 62 on which the sealing liquid affinity treatment has been performed is rendered liquid-repellent in the same manner as the area 61. The liquid-repellent treatment area indicated by the reference numeral 63 is hereinafter referred to as "second liquid-repellent treatment part."

The liquid-repellent treatment is a surface treatment that brings about the effect of repelling ink or sealing liquid, and a liquid-repellent layer (water-repellent layer) is formed in the area intended for this treatment. A technique such as coating by spray coating a fluorine-based compound is used, for example.

The sealing liquid affinity treatment is a treatment for forming a surface layer that has affinity with sealing liquid, in other words, a treatment for facilitating the attachment of sealing liquid. Specific examples of the sealing liquid affinity treatment when an oil-based sealing liquid is used include an aspect in which nickel (Ni), aluminum (Al), stainless steel, or another metal material surface is used, and an aspect in which a sealing liquid affinity layer is formed by a silicon single crystal substrate or another inorganic material, or a polyimide resin. Specific aspects of the sealing liquid affinity treatment are suitably designed with consideration given to the relationship with the sealing liquid to be used.

Organic solvents or oils that are liquid at room temperature may be used as the sealing liquid when a water-based ink is used. Examples include octane, nonane, tetradecane, dodecane, or another hydrocarbon; oleic acid, linoleic acid, or another higher fatty acid; n-decanol, dimethyl butanol, or another water-insoluble alcohol; and dibutyl phthalate, dibutyl maleate, or another plasticizer. Vegetable oil, mineral oil, silicone oil, fluorine oil, or another oil may also be used. These may be used alone, or in a combination of a plurality of types as long as they can be uniformly mixed.

The liquid-repellent treatment parts 61 and 63 are represented by the following formula that takes into account the relationship between the sealing liquid, sealing liquid affinity treatment part 62, and the surface energy of the ink:

Liquid-repellent treatment part<Sealing liquid≦Sealing liquid affinity treatment part<Ink.

In other words, the liquid-repellent treatment parts 61 and 63 have the effect of repelling sealing liquid and ink. The sealing liquid is repelled by the liquid-repellent treatment parts 61 and 63, but is easily attached to the sealing liquid affinity treatment part 62. The sealing treatment affinity treatment part 62 has affinity for sealing liquid, but repels ink.

Figure 4:
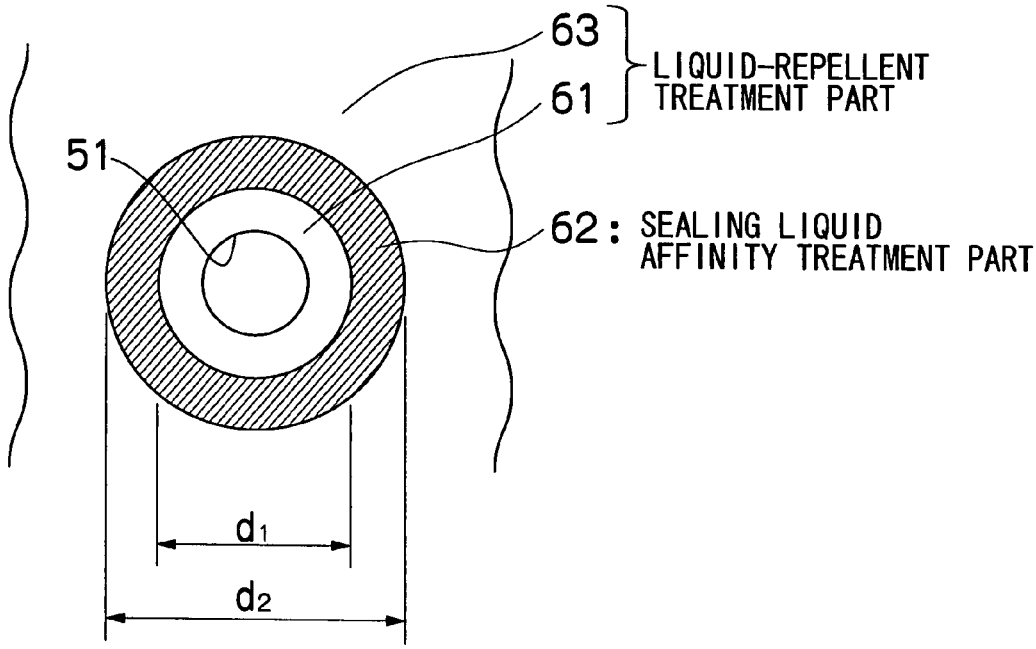
FIG. 4 is an enlarged view showing the positional relationship of the surface treatment area in the area around a nozzle.

FIG. 4 is an enlarged view showing the positional relationship of the surface treatment area in the area around a nozzle. As shown in the same diagram, the part in the area around the nozzle 51 is configured such that a plurality of ring-shaped areas (reference numerals 61 and 62 in FIG. 4) is drawn in the form of concentric circles about the opening circle (nozzle hole) of the nozzle 51. The circumferential area in contact with the nozzle 51 is the first liquid-repellent part 61, the area outside thereof is the sealing liquid affinity treatment part 62, and the area further outside thereof is the second liquid-repellent treatment part 63.

The size (outside diameters d1 and d2) of the first liquid-repellent treatment part 61 and the sealing liquid affinity treatment part 62 should be suitably designed. For example, when the diameter of the nozzle 51 is about 30 μm, the outer diameter d1 of the first liquid-repellent treatment part 61 should be set to be on the order of about 100 μm, and the outer diameter d2 of the sealing liquid affinity treatment part 62 should be set to be on the order of about several 100 μm (200 to 300 μm, for example).

Description of the Sealing Liquid Application Part

Figure 5:
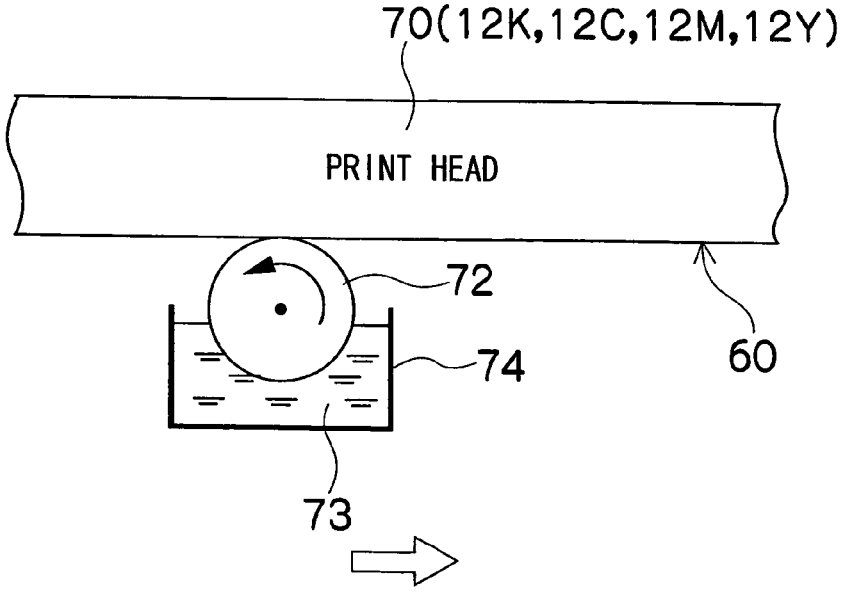
FIG. 5 is a schematic structural diagram showing an example of the sealing liquid application part.

FIG. 5 is a schematic structural diagram showing an example of the sealing liquid application part. The application part shown in FIG. 5 has a liquid supply roller 72 that is rotatably driven while in contact with the ink discharge surface 60 of the print head 70 (corresponding to 12K, 12C, 12M, and 12Y), and also has a container 74 in which sealing liquid 73 is stored; and these have a structure that allows integral movement along the ink discharge surface 60 by means of a drive mechanism (not shown).

The liquid supply roller 72 is preferably configured with an expanded material that has affinity and osmotic characteristics with respect to the sealing liquid 73, and the material affinity for the sealing liquid is preferably set to be less than the that of the sealing liquid affinity treatment part 62 disposed on the ink discharge surface 60. The liquid supply roller 72 is configured using an expanded porous urethane material, an expanded porous silicone material, or another material having sealing liquid 73 holding (or impregnated) characteristics, for example. The affinity of the liquid supply roller 72 for the sealing liquid is set by adjusting the osmotic pressure and the size of the porous cells.

A portion of the liquid supply roller 72 is immersed in the sealing liquid 73 inside the container 74, and the sealing liquid 73 impregnated in the liquid supply roller 72 is applied to the ink discharged surface 60 of the print head 70 when the liquid supply roller 72 moves while being rotatably driven on the ink discharge surface 60 by a drive mechanism (not shown). In the diagram, the unit composed of the liquid supply roller 72 and the container 74 is shown to be moving from left to right in FIG. 5 to apply the sealing liquid 73.

Figure 6:
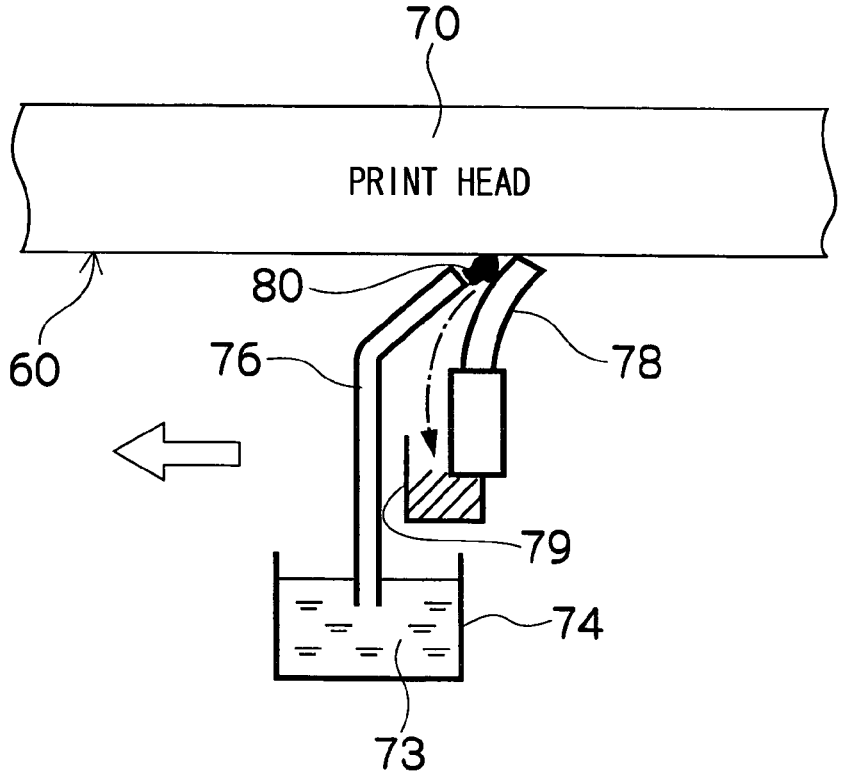
FIG. 6 is a schematic structural diagram showing another structural example of the sealing liquid application part.

FIG. 6 is a schematic structural diagram showing another structural example of the sealing liquid application part. The application part shown in FIG. 6 has a liquid provision tube 76 for providing the sealing liquid 73 from the container 74 in which the sealing liquid 73 is stored to the ink discharge surface 60 of the print head 70, a blade 78 for slidably rubbing against the ink discharge surface 60, and a recovery container 79 for recovering excess sealing liquid 73 wiped away with the blade 78. These have a structure that allows integral movement along the ink discharge surface 60 by means of a drive mechanism (not shown). In the diagram, the blade 78 is shown to be coating the sealing liquid 73 by moving right to left in FIG. 6.

The sealing liquid 73 is led to the vicinity of the contact point of the blade 78 by the liquid provision tube 76, and the sealing liquid 73 is provided from the liquid supply port 80 at the tip of the liquid provision tube 76 to the ink discharge surface 60. The sealing liquid 73 is thereafter applied to the ink discharge surface 60 by the slidably rubbing blade 78 as the sealing liquid 73 is provided from the liquid supply port 80. The excess sealing liquid 73 is wiped away by the blade 78 and returned to the recovery container 79. Here, the recovered sealing liquid 73 may be returned to the container for storing the sealing liquid 73, and the container 74 may double as the recovery container 79.

The sealing liquid 73 is attached solely on the sealing liquid affinity treatment part 62 in the area around the nozzles by delivering the sealing liquid 73 to the ink discharge surface 60 by means of the application part exemplified in FIG. 5 or 6. A condition can be brought about in which the sealing liquid 73 is not attached to the externally disposed liquid-repellent treatment part (i.e. second liquid-repellent treatment part 63).

Figure 7:
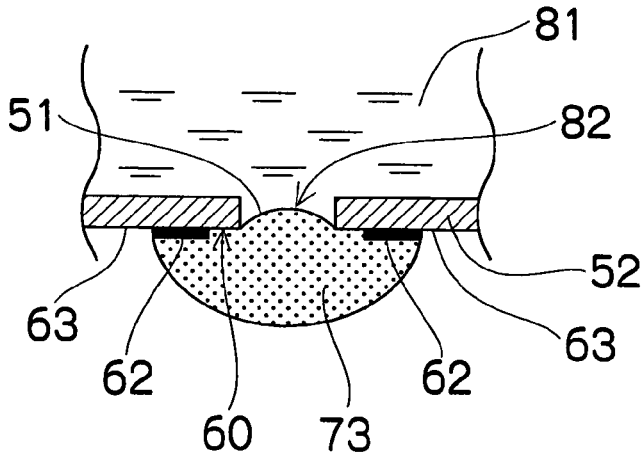
FIG. 7 is a cross-sectional view showing the attached state of the sealing liquid in the vicinity of a nozzle.

FIG. 7 shows the sealing liquid in an attached state. As shown in the diagram, the meniscus 82 is formed by the negative pressure of the ink 81 at the tip of the nozzle 51. When the sealing liquid 73 is applied to the ink discharge surface 60 of the nozzle plate 52, the sealing liquid 73 is attached to the sealing liquid affinity treatment part 62 in the vicinity of the nozzle 51, and the meniscus 82 is sealed in by the sealing liquid 73. The area around the outside of the sealing liquid affinity treatment part 62 is the second liquid-repellent treatment part 63, which has been treated with a liquid repellent, so the sealing liquid 73 is not attached in the area outside of the sealing liquid affinity treatment part 62.

Solely the area in the vicinity of the nozzle 51 can thereby be covered with a small amount of sealing liquid 73.

Figure 8:
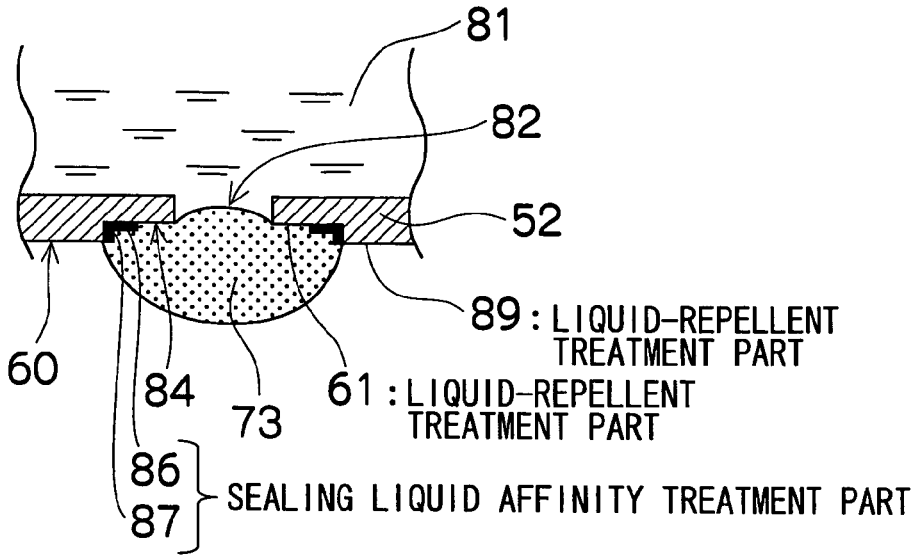
FIG. 8 is a cross-sectional view showing an example of the sealing liquid affinity treatment part with a recess shape.

A recess portion 84 with a stepped structure one step lower than the ink discharge surface 60 is preferably formed in the area around the nozzle 51, as shown in FIG. 8, as a part for further improving the characteristics for holding sealing liquid 73. Of the bottom surface of the recess portion 84, a sealing liquid affinity treatment is performed on the peripheral area 86 that is further outside of the first liquid-repellent treatment part 61 that is in contact with the discharge port of the nozzle 51, and on the entire circumference of the side surface 87 of the recess portion 84. A liquid-repellent treatment is performed in the area 89 (i.e. the flat portion of the ink discharge surface 60) outside of the recess portion 84. This configuration makes it possible to vary the contact surface of the sealing liquid 73 in the corner portion of the recess portion 84 and in the area outside of the recess portion 84 with the variable surface of the stepped structure, and to enhance the holding force and facilitate the attachment of the sealing liquid 73 on the inner side of the recess portion 84 because of the variable treatment.

FIGS. 9 to 13 are cross-sectional views showing other structural examples of the contact liquid holding area in the sealing liquid affinity treatment part. In these diagrams, the same symbols are assigned to the same or similar parts as the example in FIG. 8, and description thereof is omitted.

Figure 9:
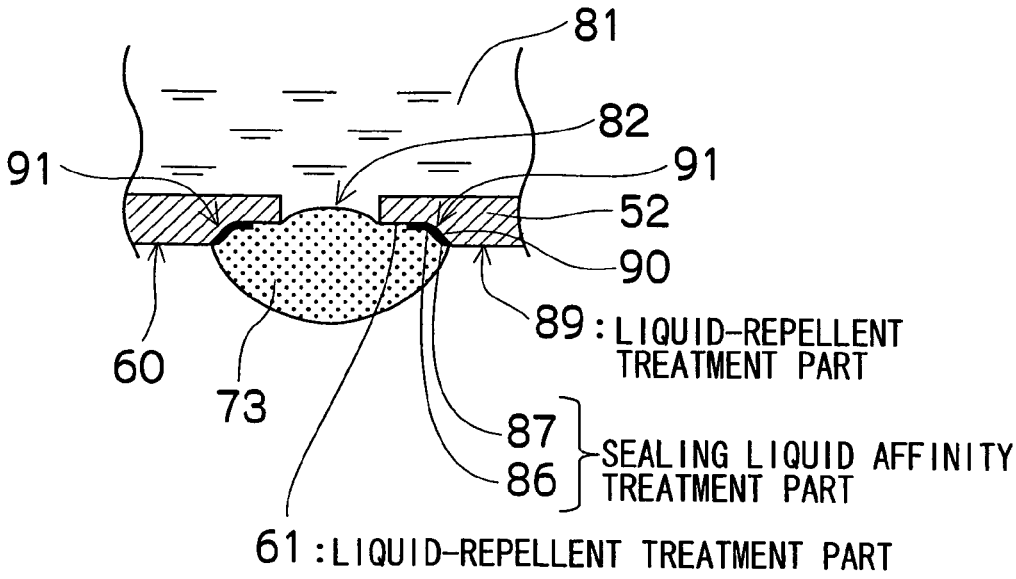
FIG. 9 is a cross-sectional view showing another structural example in the contact liquid holding area of the sealing liquid affinity treatment part.

The cross-sectional shape of the recess portion 84 may be diagonally widened from the bottom surface of the recess portion 84 toward the outside (the lower side in the FIG. 9). Shown in FIG. 9 is an example in which the bottom surface of the recess portion 84 and the corner 91 of the diagonally widened sloping side surface 90 are given an arcuate (or rounded) shape, but the corner shape is not limited to the example shown in the diagram, and also possible is a shape in which an angled (or unrounded) portion remains.

Figure 10:
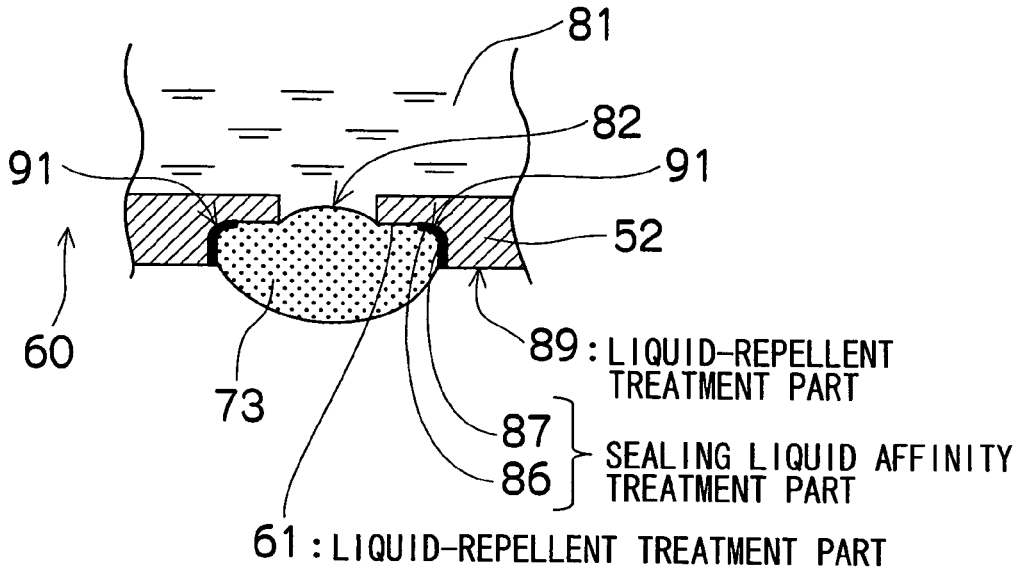
FIG. 10 is a cross-sectional view showing another structural example in the contact liquid holding area of the sealing liquid affinity treatment part.

Also possible is a shape in which the bottom surface of the recess portion 84 and the corner of the side surface 87 of the recess portion 84 formed into an arcuate shape, as shown in FIG. 10. The configurations exemplified FIGS. 9 and 10 allow the amount of residual sealing liquid to be reduced when this liquid is removed.

Figure 11:
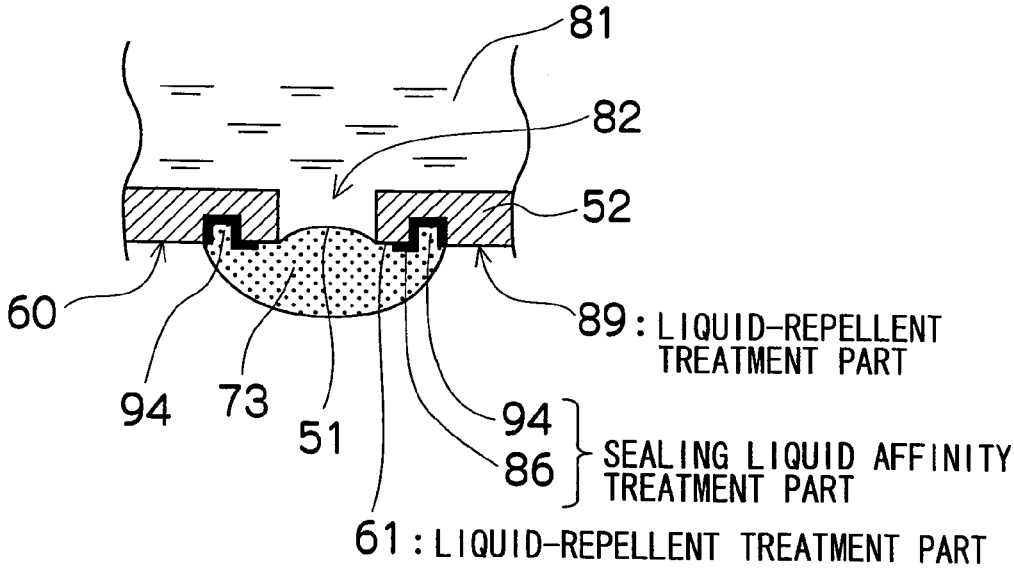
FIG. 11 is a cross-sectional view showing another structural example in the contact liquid holding area of the sealing liquid affinity treatment part.

In the example shown in FIG. 11, a groove 94 is formed in the peripheral vicinity of the nozzle 51 in the ink discharge surface 60 of the nozzle plate 52, and the structure is one in which a sealing liquid affinity treatment is performed on the inner surface of the groove 94. Since this configuration is suitable for processing such as etching and the processing does not affect to the nozzle hole, there is no change in the shape of the nozzle and therefore no adverse effect on the flight characteristics.

Figure 12:
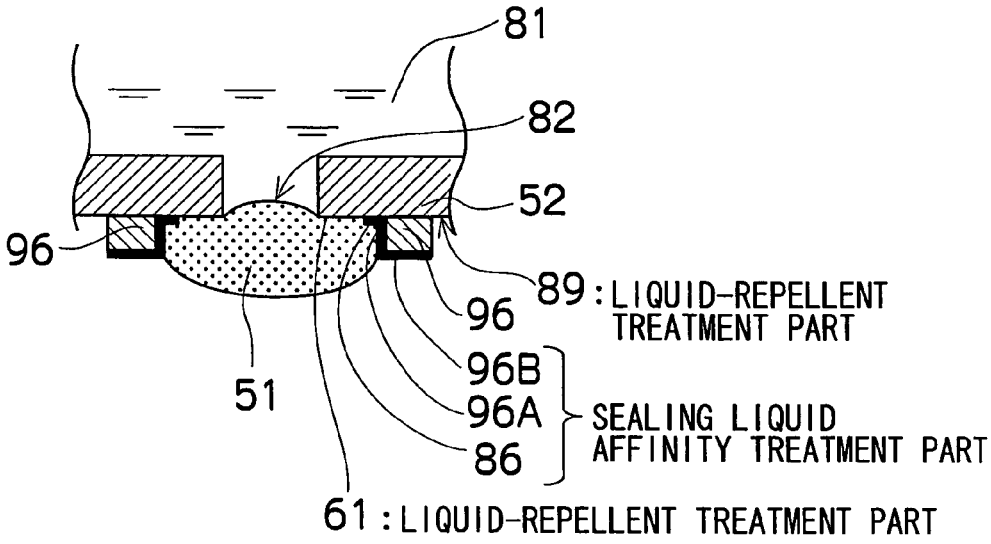
FIG. 12 is a cross-sectional view showing another structural example in the contact liquid holding area of the sealing liquid affinity treatment part.

In the example shown in FIG. 12, a protruding portion 96 is formed in the peripheral vicinity of the nozzle 51 in the ink discharge surface 60 of the nozzle plate 52, and a sealing liquid affinity treatment is performed on the side surface 96A and the lower surface 96B of the protruding portion 96 that faces the nozzle 51. This protruding portion 96 can be formed by electroless nickel plating, for example. This configuration is easily processed, and since processing does not extend to the nozzle hole, there is no adverse effect on the flight characteristics.

Figure 13:
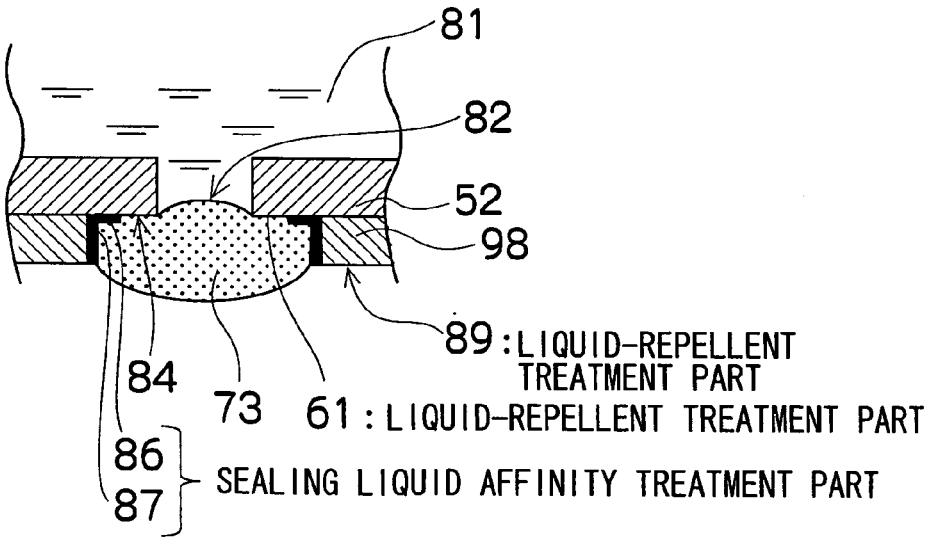
FIG. 13 is a cross-sectional view showing another structural example in the contact liquid holding area of the sealing liquid affinity treatment part.

Furthermore, as shown in FIG. 13, a recess portion 84 may be formed by plating a stepped layer 98 on the lower surface of the nozzle plate 52 even when the same recess shape as in FIG. 8 is formed.

The implementation of the present invention is not limited to an aspect in which a sealing liquid affinity treatment part 62 is formed individually for each of the nozzles 51 in the print head 70, but also possible is an aspect in which a sealing liquid affinity treatment part is formed around a group of nozzles.

Figure 14:
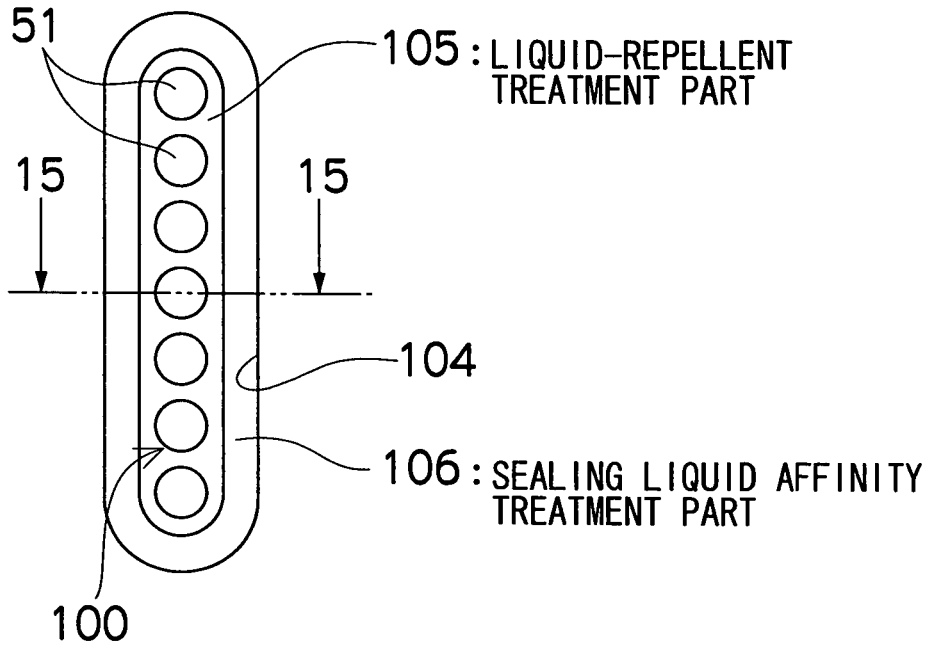
FIG. 14 is a diagram showing an example of forming a sealing liquid affinity to treatment part in the area around a group of nozzles.
Figure 15:
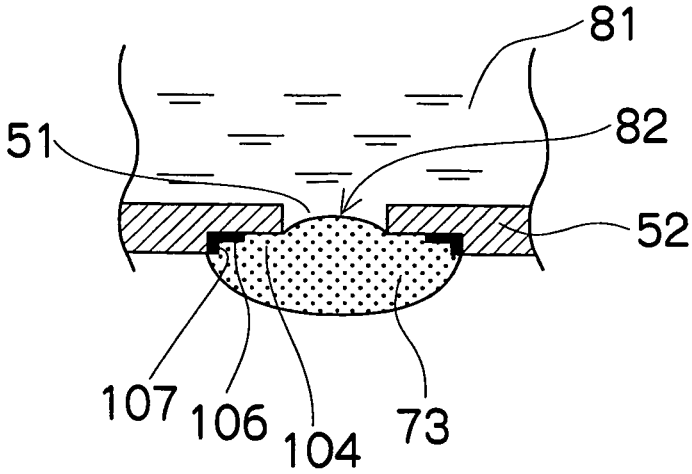
FIG. 15 is a cross-sectional view along line 15-15 in FIG. 14.

FIG. 14 is a diagram showing an example of forming a sealing liquid affinity treatment part in the area around a group of nozzles. FIG. 15 is a cross-sectional view along line 15-15 in FIG. 14.

As shown in these diagrams, in an aspect in which a nozzle group 100 arrayed with a plurality of nozzles 51 is formed, a recess portion 104 surrounding the nozzle group 100 is formed around the nozzle group 100, a liquid-repellent treatment is performed in the area 105 of the bottom surface of the recess portion 104 that is in contact with the nozzles 51, and a sealing liquid affinity treatment is performed in the outer peripheral area 106 thereof. Also, a sealing liquid affinity treatment is performed around the entire circumference of the side surface 107 of the recess portion 104 (refer to FIG. 10).

In this configuration, the entire nozzle group 100 surrounded by the recess portion 104 is covered with the sealing liquid 73. Thus, the sealing liquid 73 can be used in a smaller amount by keeping the attachment range of sealing liquid 73 to a minimum range around the nozzle group 100.

Description of the Sealing Liquid Removal Part

As described above, the meniscus 82 is covered with a sealing liquid 73 to prevent the meniscus from drying on printing standby. During subsequent printing, the sealing liquid 73 attached to the ink discharge surface 60 is removed prior to printing.

Figure 16:
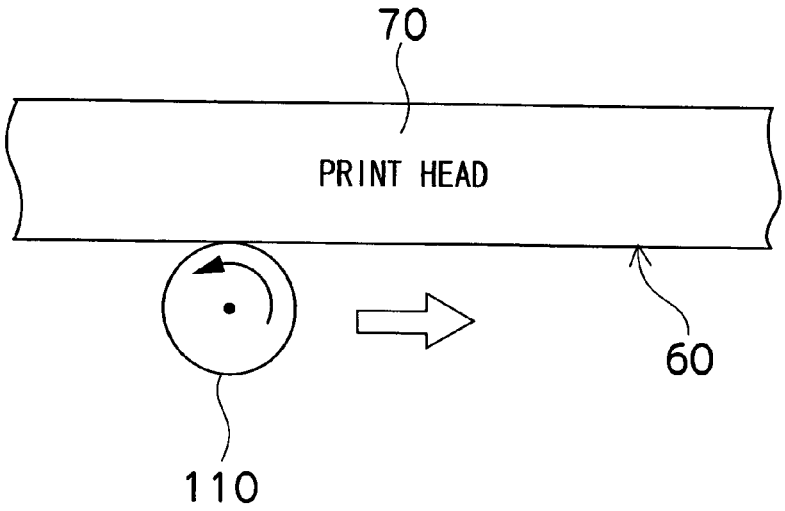
FIG. 16 is a schematic structural diagram showing an example of the sealing liquid removal part.

FIG. 16 is a schematic structural diagram showing an example of the sealing liquid removal part. The sealing liquid removal part shown in FIG. 16 absorbs away the sealing liquid 73 by using a liquid absorbent roller 110 that is rotatably driven on the ink discharge surface 60 of the print head 70. In the diagram, the liquid absorbent roller 110 is shown to be removing the sealing liquid 73 while moving right to left in FIG. 16.

The material of the liquid absorbent roller 110 preferably has affinity for the sealing liquid and is an expanded material with osmotic characteristics. The affinity is furthermore preferably set to be greater than that afforded by the sealing liquid affinity treatment part 62 formed on the discharge surface 60.

This aspect makes it possible for the sealing liquid 73 attached to the sealing liquid affinity treatment part 62 to be efficiently removed. By providing a wringing mechanism (not shown) for wringing the liquid absorbent roller 110 into which the sealing liquid 73 has been absorbed, it is possible to reuse the wrung sealing liquid 73.

Figure 17:
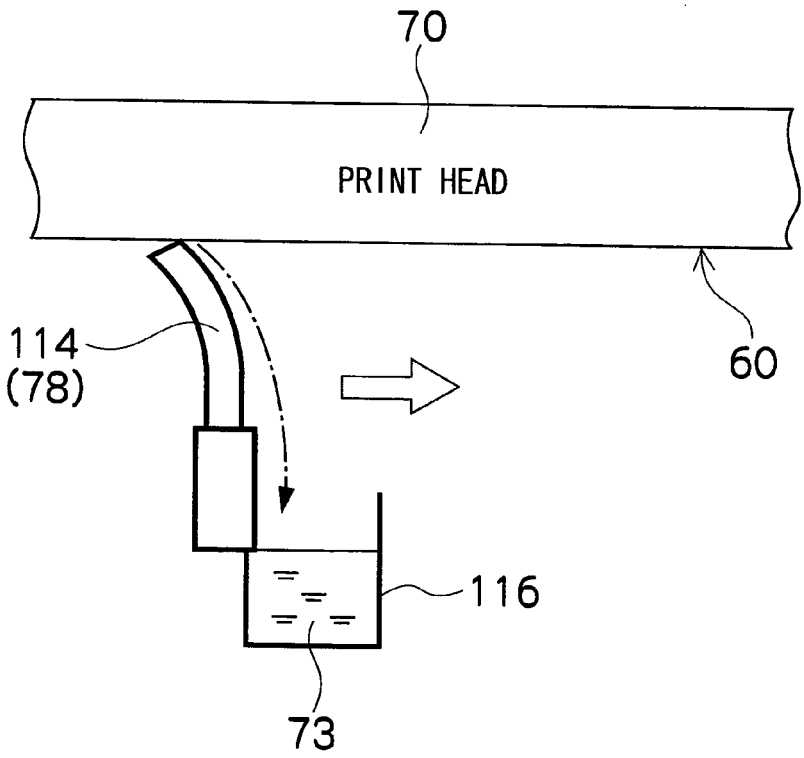
FIG. 17 is a schematic structural diagram showing another structural example of the sealing liquid application part.

FIG. 17 is a schematic structural diagram showing another structural example of the sealing liquid application part. The sealing liquid application part shown in FIG. 17 has a blade 114 for slidably rubbing against the ink discharge surface 60 of the print head 70, and a recovery container 116 for recovering excess sealing liquid 73 wiped away with the blade 114. These components have a structure that allows integral movement along the ink discharge surface 60 by means of a drive mechanism (not shown). In the diagram, the blade 114 is shown to be removing the sealing liquid 73 by moving right to left in FIG. 17.

The blade 114 uses a soft rubber material, and removal performance can be improved by increasing adherence with the sealing liquid affinity treatment part 62.

The sealing liquid removal part shown in FIG. 17 may double as the sealing liquid application part described in FIG. 6. In other words, the blade 78 described in FIG. 6 can be used for coating and removal, and the sealing liquid 73 can be wiped away by action in the direction opposite from that during coating action for the sealing liquid 73 described in FIG. 6.

When the sealing liquid affinity treatment area has a recess shape, as shown in FIGS. 8 to 15, it is difficult to remove the sealing liquid with a blade, so a preferred aspect is one in which the liquid absorbent roller 110 described in FIG. 16 is used.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording head comprising:

a nozzle which discharges ink;

a liquid-repellent treatment part which repels the ink and sealing liquid used for sealing off the ink inside the nozzle from outside air; and a sealing liquid affinity treatment part that has an affinity with the sealing liquid, wherein the liquid-repellent treatment part contacts the sealing liquid affinity treatment part and both parts are provided on a discharge surface in which a discharge port of the nozzle is formed, and the sealing liquid affinity treatment part completely surrounds the liquid-repellent treatment part.

2. The inkjet recording head as defined in claim 1, wherein:

the liquid-repellent treatment part is formed in an area on the discharge surface that is in contact with the discharge port of the nozzle; and the sealing liquid affinity treatment part is formed on the outside of the liquid-repellent treatment part.

3. The inkjet recording head as defined in claim 2, wherein the sealing liquid affinity treatment part has a recess shape.

4. An image formation apparatus comprising:

the inkjet recording head as defined in claim 3;

a sealing liquid application part which provides sealing liquid to the discharge surface; and a sealing liquid removal part which removes the sealing liquid attached to the discharge surface.

5. An image formation apparatus comprising:

the inkjet recording head as defined in claim 2;

a sealing liquid application part which provides sealing liquid to the discharge surface; and a sealing liquid removal part which removes the sealing liquid attached to the discharge surface.

6. The inkjet recording head as defined in claim 1, wherein the sealing liquid affinity treatment part has a recess shape.

7. An image formation apparatus comprising:

the inkjet recording head as defined in claim 6;

a sealing liquid application part which provides sealing liquid to the discharge surface; and a sealing liquid removal part which removes the sealing liquid attached to the discharge surface.

8. An image formation apparatus comprising:

the inkjet recording head as defined in claim 1;

a sealing liquid application part which provides sealing liquid to the discharge surface; and a sealing liquid removal part which removes the sealing liquid attached to the discharge surface.

9. An inkjet recording head comprising:

a nozzle which discharges ink;

a liquid-repellent treatment part which repels the ink; and a sealing liquid affinity treatment part that has an affinity with sealing liquid used for sealing off the ink inside the nozzle from outside air, wherein the liquid-repellent treatment part and the sealing liquid affinity treatment part are provided on a discharge surface in which a discharge port of the nozzle is formed, the liquid-repellent treatment part is formed in an area on the discharge surface that is in contact with the discharge port of the nozzle, the sealing liquid affinity treatment part is formed on the outside of the liquid-repellent treatment part, and the liquid-repellent treatment part for repelling the ink is formed in an area on the discharge surface further outside of the sealing liquid affinity treatment part.

10. The inkjet recording head as defined in claim 9, wherein the sealing liquid affinity treatment part has a recess shape.

11. An image formation apparatus comprising:

the inkjet recording head as defined in claim 10;

a sealing liquid application part which provides sealing liquid to the discharge surface; and a sealing liquid removal part which removes the sealing liquid attached to the discharge surface.

12. An image formation apparatus comprising:

the inkjet recording head as defined in claim 9;

a sealing liquid application part which provides sealing liquid to the discharge surface; and a sealing liquid removal part which removes the sealing liquid attached to the discharge surface.

13. An inkjet recording head comprising:

a nozzle which discharges ink;

a liquid-repellent treatment part which repels the ink; and a sealing liquid affinity treatment part that has an affinity with sealing liquid used for sealing off the ink inside the nozzle from outside air, wherein the liquid-repellent treatment part and the sealing liquid affinity treatment part are provided on a discharge surface in which a discharge port of the nozzle is formed, and boundaries of the sealing liquid affinity treatment part on the discharge surface are defined by inner and outer peripheral boundaries of the sealing liquid affinity treatment part and boundaries of the liquid-repellent treatment part on the discharge surface are defined by inner and outer peripheral boundaries of the liquid-repellent treatment part, and the inner peripheral boundary of the sealing liquid affinity treatment part entirely surrounds and entirely contacts the outer peripheral boundary of the liquid-repellent treatment part.

* * * * *